US011174693B2

(12) United States Patent
Fripp et al.

(10) Patent No.: US 11,174,693 B2
(45) Date of Patent: Nov. 16, 2021

(54) WELL SYSTEM WITH DEGRADABLE PLUG

(71) Applicant: Halliburton Energy Services, Inc., Houston, TX (US)

(72) Inventors: Michael Linley Fripp, Carrollton, TX (US); John Charles Gano, Lowery Crossing, TX (US); Jean Marc Lopez, Plano, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 213 days.

(21) Appl. No.: 16/390,583

(22) Filed: Apr. 22, 2019

(65) Prior Publication Data

US 2019/0249507 A1 Aug. 15, 2019

Related U.S. Application Data

(62) Division of application No. 15/111,366, filed as application No. PCT/US2014/073009 on Dec. 31, 2014, now abandoned.

(51) Int. Cl.

| | |
|---|---|
| ***E21B 29/02*** | (2006.01) |
| ***E21B 33/06*** | (2006.01) |
| ***E21B 43/12*** | (2006.01) |
| ***E21B 33/12*** | (2006.01) |
| ***E21B 34/06*** | (2006.01) |
| ***E21B 43/08*** | (2006.01) |
| *E21B 43/04* | (2006.01) |

(52) U.S. Cl.

CPC ..... *E21B 29/02* (2013.01); *E21B 33/063* (2013.01); *E21B 33/12* (2013.01); *E21B 34/06* (2013.01); *E21B 43/08* (2013.01); *E21B 43/12* (2013.01); *E21B 43/04* (2013.01); *E21B 43/084* (2013.01)

(58) Field of Classification Search

CPC ..... E21B 43/08; E21B 29/02; E21B 33/063; E21B 43/12; E21B 33/12; E21B 34/06; E21B 43/04; E21B 43/084; E21B 34/063

See application file for complete search history.

(56) References Cited

U.S. PATENT DOCUMENTS

| | | | | |
|---|---|---|---|---|
| 3,151,556 | A | 10/1964 | Karpovich | |
| 7,493,956 | B2 | 2/2009 | Shaw et al. | |
| 7,699,101 | B2 | 4/2010 | Fripp et al. | |
| 7,789,151 | B2 * | 9/2010 | Langeslag | E21B 34/06 166/296 |

(Continued)

OTHER PUBLICATIONS

International Search Report and Written Opinion, Application No. PCT/US2014/073009; 21 pgs, dated Sep. 16, 2015.

(Continued)

*Primary Examiner* — Steven A MacDonald

(74) *Attorney, Agent, or Firm* — Scott Richardson; Baker Botts L.L.P.

(57) ABSTRACT

A downhole assembly is disclosed. The downhole assembly includes a tube disposed in a wellbore, and a shroud coupled to and disposed around the circumference of the tube to form an annulus between an inner surface of the shroud and an outer surface of the tube. The downhole assembly further includes a flow control device disposed in the annulus, and a degradable plug disposed in the annulus and positioned to prevent fluid flow between the annulus and the tube.

18 Claims, 7 Drawing Sheets

(56) References Cited

U.S. PATENT DOCUMENTS 7,789,152 B2 * 9/2010 Langeslag ..... E21B 43/086 166/296
7,918,272 B2 * 4/2011 Gaudette ..... E21B 43/12 166/205
8,430,174 B2 4/2013 Holderman et al.
8,851,190 B1 10/2014 Lopez
9,611,711 B2 * 4/2017 Peterson ..... E21B 34/063
2006/0048942 A1 * 3/2006 Moen ..... E21B 43/12 166/306
2006/0276345 A1 12/2006 Todd et al.
2008/0135249 A1 * 6/2008 Fripp ..... E21B 43/088 166/285
2008/0169099 A1 * 7/2008 Pensgaard ..... E21B 33/138 166/285
2009/0205834 A1 * 8/2009 Garcia ..... E21B 43/12 166/373
2010/0270031 A1 10/2010 Patel
2011/0024111 A1 * 2/2011 Moen ..... E21B 47/11 166/278
2011/0135953 A1 * 6/2011 Xu ..... B22F 1/02 428/548
2011/0147014 A1 * 6/2011 Chen ..... E21B 33/1208 166/387
2013/0186626 A1 * 7/2013 Aitken ..... E21B 34/085 166/285
2013/0192827 A1 * 8/2013 Garcia ..... E21B 23/06 166/281
2013/0220632 A1 8/2013 Greci
2013/0327540 A1 12/2013 Hamid et al.
2014/0020898 A1 * 1/2014 Holderman ..... E21B 43/08 166/304
2014/0034324 A1 2/2014 Lopez
2014/0262207 A1 * 9/2014 Lopez ..... E21B 34/08 166/114
2014/0318780 A1 * 10/2014 Howard ..... E21B 34/06 166/285
2015/0240587 A1 * 8/2015 Peterson ..... E21B 33/1208 166/296
2016/0024897 A1 * 1/2016 Greci ..... E21B 43/08 166/296
2016/0230509 A1 * 8/2016 Lopez ..... E21B 41/00

OTHER PUBLICATIONS

Abela, Stephen, "Protective Coatings for Magnesium Alloys, Magnesium Alloys—Corrosion and Surface Treatments," Frank Czerwinski (Ed.), ISBN: 978-953-307-972-1, InTech, Available from: http://www.intechopen.com/books/magnesium-alloys-corrosion-and-surface-treatments/protective-coatingsfor-magnesium-alloys, 2011.
International Preliminary Report on Patentability for PCT Patent Application No. PCT/US2014/073009, dated Jul. 13, 2017; 17 pages.
Office Action for Great Britain Patent Application No. GB1706364.5, dated Jul. 17, 2017; 2 pages.
Office Action for Great Britain Patent Application No. GB1720797.8, dated Feb. 26, 2018; 5 pages.
Office Action for Australian Patent Application No. 2014415564, dated Apr. 26, 2018; 4 pages.
Office Action for Canadian Patent Application No. 2968216, dated Apr. 12, 2018; 3 pages.
Office Action for Australian Patent Application No. 2014415564, dated Jul. 19, 2018; 5 pages.
Office Action for Canadian Patent Application No. 2,968,216, dated Nov. 8, 2018; 3 pages.
Office Action for Australian Patent Application No. 2014415564, dated Oct. 12, 2018; 8 pages.
Office Action for Australian Patent Application No. 2014415564, dated Feb. 22, 2019; 6 pages.
Office Action for Great Britain Patent Application No. GB1720797.8, dated Dec. 19, 2018; 4 pages.
Office Action for Great Britain Patent Application No. GB1706364.5, dated Dec. 19, 2018; 2 pages.

* cited by examiner

WELL SYSTEM WITH DEGRADABLE PLUG

RELATED APPLICATIONS

This application is a U.S. Divisional Application of U.S. patent application Ser. No. 15/111,366 filed Jul. 13, 2016, which is a U.S. National Stage Application of International Application No. PCT/US2014/073009 filed Dec. 31, 2014, which designates the United States, and which are incorporated herein by reference in their entirety.

TECHNICAL FIELD

The present disclosure is related to downhole tools for use in a wellbore environment and more particularly to degradable plugs used to temporarily block fluid flow in a well system.

BACKGROUND OF THE DISCLOSURE

After a wellbore has been formed for the purpose of exploration or extraction of natural resources such as hydrocarbons or water, various downhole tools may be inserted into the wellbore to extract the natural resources from the wellbore and/or to maintain the wellbore. At various times during production and/or maintenance operations, it may be necessary to temporarily block the flow of fluid into or out of various portions of the wellbore or various portions of the downhole tools used in the wellbore.

BRIEF DESCRIPTION OF THE DRAWINGS

A more complete and thorough understanding of the various embodiments and advantages thereof may be acquired by referring to the following description taken in conjunction with the accompanying drawings, in which like reference numbers indicate like features, and wherein.

DETAILED DESCRIPTION OF THE DISCLOSURE

Embodiments of the present disclosure and its advantages may be understood by referring to FIGS. 1 through 7, where like numbers are used to indicate like and corresponding parts.

Production fluids, including hydrocarbons, water, sediment, and other materials or substances found in a formation may flow from the formation into a wellbore through the sidewalls of the open hole portions of the wellbore. The production fluids may circulate in the wellbore before being extracted via a downhole assembly. The downhole assembly may include a screen to filter sediment from the production fluids flowing into the downhole assembly and a flow control device to regulate the flow of production fluids into the downhole assembly. Similarly, injection fluids may flow from a production string into the downhole assembly before flowing into the wellbore. A plug may be used to temporarily prevent flow of production or injection fluids between the downhole assembly and the wellbore. The plug may be positioned axially with respect to the flow control device. To resume fluid flow between the downhole assembly and the wellbore, the plug may be removed. To avoid the cost and time associated with manual removal of the plug, it may be removed via a chemical reaction that causes the plug to degrade within the wellbore.

Figure 1:
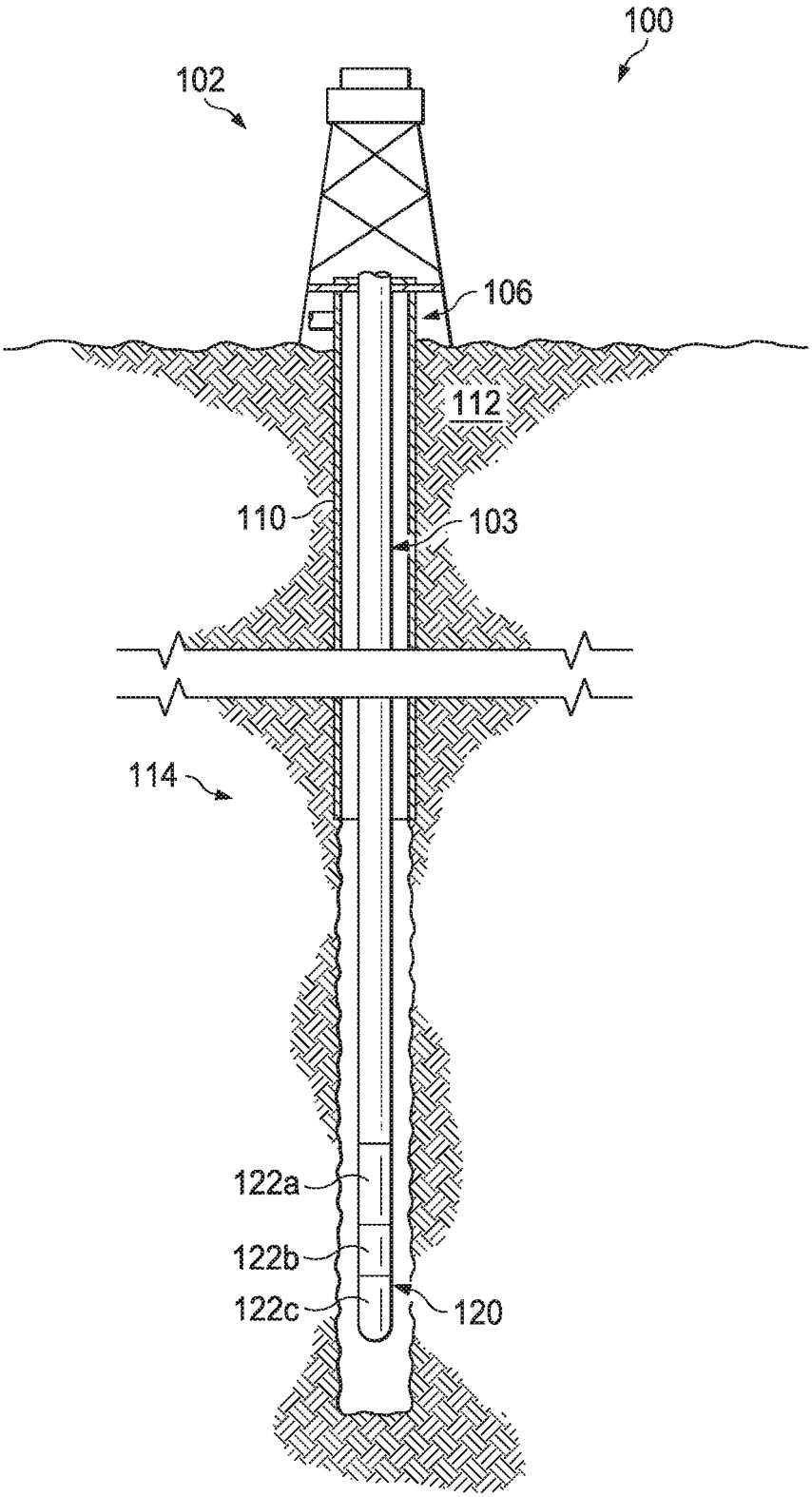
FIG. 1 is an elevation view of a well system.

FIG. 1 is an elevation view of an example embodiment of a well system. Well system 100 may include well surface or well site 106. Various types of equipment such as a rotary table, drilling fluid or production fluid pumps, drilling fluid tanks (not expressly shown), and other drilling or production equipment may be located at well surface or well site 106. For example, well site 106 may include drilling rig 102 that may have various characteristics and features associated with a "land drilling rig." However, downhole drilling tools incorporating teachings of the present disclosure may be satisfactorily used with drilling equipment located on offshore platforms, drill ships, semi-submersibles and drilling barges (not expressly shown).

Well system 100 may also include production string 103, which may be used to produce hydrocarbons such as oil and gas and other natural resources such as water from formation 112 via wellbore 114. Alternatively, or additionally, production string 103 may be used to inject hydrocarbons such as oil and gas and other natural resources such as water into formation 112 via wellbore 114. As shown in FIG. 1, wellbore 114 is substantially vertical (e.g., substantially perpendicular to the surface). In other embodiments, portions of wellbore 114 may be substantially horizontal (e.g., substantially parallel to the surface), or at an angle between vertical and horizontal. Casing string 110 may be placed in wellbore 114 and held in place by cement, which may be injected between casing string 110 and the sidewalls of wellbore 114. Casing string 110 may provide radial support to wellbore 114 and may seal against unwanted communication of fluids between wellbore 114 and surrounding formation 112. Casting string 110 may extend from well surface 106 to a selected downhole location within wellbore 114. Portions of wellbore 114 that do not include casing string 110 may be described as "open hole."

The terms "uphole" and "downhole" may be used to describe the location of various components relative to the bottom or end of wellbore 114 shown in FIG. 1. For example, a first component described as uphole from a second component may be further away from the end of wellbore 114 than the second component. Similarly, a first component described as being downhole from a second component may be located closer to the end of wellbore 114 than the second component.

Well system 100 may also include downhole assembly 120 coupled to production string 103. Downhole assembly 120 may be used to perform operations relating to the completion of wellbore 114, the production of hydrocarbons and other natural resources from formation 112 via wellbore 114, the injection of hydrocarbons and other natural resources into formation 112 via wellbore 114, and/or the maintenance of wellbore 114. Downhole assembly 120 may be located at the end of wellbore 114 or at a point uphole from the end of wellbore 114. Downhole assembly 120 may be formed from a wide variety of components configured to perform these operations. For example, components 122*a*, 122*b* and 122*c* of downhole assembly 120 may include, but are not limited to, screens, flow control devices, slotted tubing, packers, valves, sensors, and actuators. The number and types of components 122 included in downhole assembly 120 may depend on the type of wellbore, the operations being performed in the wellbore, and anticipated wellbore conditions.

Production fluids, including hydrocarbons, water, sediment, and other materials or substances found in formation 112 may flow from formation 112 into wellbore 114 through the sidewalls of the open hole portions of wellbore 114. The production fluids may circulate in wellbore 114 before being extracted via production string 103. Alternatively, or additionally, injection fluids, including hydrocarbons, water, and other materials, may be injected into wellbore 114 and formation 112 via production string 103 and downhole assembly 120. Downhole assembly 120 may include a screen (shown in FIG. 2) to filter sediment from production fluids flowing into production string 103. Downhole assembly 120 may also include a flow control device to regulate the flow of production fluids into production string 103. Downhole assembly 120 may also include a plug that may be used to temporarily prevent flow of production fluids into production string 103 or injection fluids out of production string 103. To avoid the cost and time associated with manual removal of the plug, it may be removed via a chemical reaction that causes the plug to degrade within wellbore 114.

Figure 2:
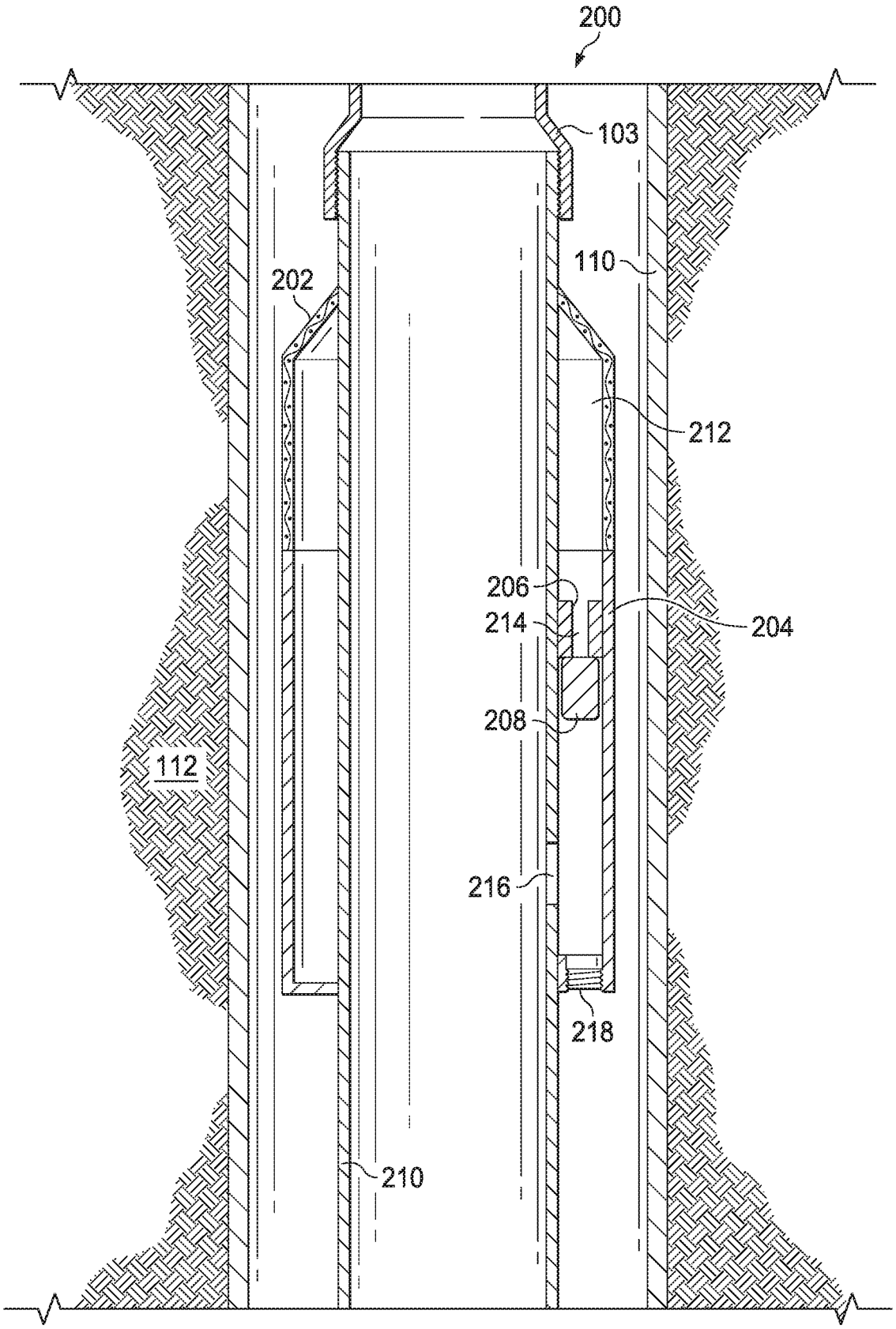
FIG. 2 is a cross-sectional view of a downhole assembly including a degradable plug in-line with and adjacent to a flow control device.

FIG. 2 is a cross-sectional view of a downhole assembly including a degradable plug in-line with and adjacent to a flow control device. Production fluids circulating in wellbore 114 may flow through downhole assembly 200 into production string 103. Downhole assembly 200 may be located downhole from production string 103 and may be coupled to production string via tubing 210. In some embodiments, downhole assembly 200 may be coupled to production string 103 by a threaded joint. In other embodiments, a different coupling mechanism may be employed. The coupling of downhole assembly 200 and production string 103 may also provide a fluid and pressure tight seal.

Downhole assembly 200 may include screen 202 and shroud 204, which may be coupled to and disposed downhole from screen 202. Both screen 202 and shroud 204 may be coupled to and disposed around the circumference of tubing 210 such that annulus 212 is formed between the inner surfaces of screen 202 and shroud 204 and the outer surface of tubing 210. Production fluids circulating in wellbore 114 may enter downhole assembly 200 by flowing through screen 202 into annulus 212. Screen 202 may be configured to filter sediment from production fluids as they flow through screen 202. Screen 202 may include, but is not limited to, a sand screen, a gravel filter, a mesh, or slotted tubing.

Downhole assembly 200 may also include flow control device 206 disposed within annulus 212 between shroud 204 and tubing 210. Flow control device 206 may include channel 214 extending there through to permit the flow of production fluids through flow control device 206. Flow control device 206 may engage with shroud 204 and tubing 210 to prevent production fluids circulating in annulus 212 from flowing between flow control device 206 and tubing 210 or shroud 204. For example, flow control device 206 may engage with the inner surface of shroud 204 to form a fluid and pressure tight seal and may engage with the outer surface of tubing 210 to form a fluid and pressure tight seal. Because flow control device 206 engages with tubing 210 and shroud 204 to form a fluid and pressure tight seal, production fluids circulating in annulus 212 flow through channel 214 rather than between flow control device 206 and tubing 210 or between flow control device 206 and shroud 204.

The flow of production fluids through channel 214 may be temporarily blocked by plug 208 disposed in a portion of annulus 212 downhole from flow control device 206. Plug 208 may be positioned in-line with and adjacent to flow control device 206, as shown in FIG. 2. Plug 208 may engage with shroud 204 and tubing 210 to form a fluid and pressure tight seal, thereby preventing production fluids from flowing into the portion of annulus downhole from flow control device 206. Plug 208 may also be used to temporarily block the flow of injection fluids from production string 103 into wellbore 114 and formation 112. For example, the flow of injection fluids from production string into wellbore 114 and formation 112 may be temporarily blocked by plug 208 positioned in-line with and adjacent to flow control device 206, as shown in FIG. 2. Plug 208 may engage with shroud 204 and tubing 210 to form a fluid and pressure tight seal, thereby preventing injection fluids from flowing into the portion of annulus uphole from flow control device 206.

Plug 208 may be formed of a degradable composition including a metal or alloy that is reactive under defined conditions. Plug 208 may be removed from annulus 212 using a chemical reaction that causes plug 208 to degrade, thereby avoiding manual intervention required to extract plug 208 from annulus 212 using a retrieval tool. The term "degrade" may be used to describe a process by which a component breaks down into pieces or dissolves into particles small enough that they do not impede the flow of fluids. The features of plug 208, including its degradability, are described in additional detail with respect to FIGS. 5A-5E and 6A-6D. Once the chemical reaction causing plug 208 to degrade has been triggered, the reaction may continue until plug 208 breaks down into pieces or dissolves into particles small enough that they do not impede the flow of production fluids through channel 214 of flow control device 206. When plug 208 has degraded to this point, production fluids may flow through channel 214 of flow control device 206 and into the portion of annulus 212 downhole from flow control device 206. From there, the production fluids may flow through opening 216 formed in a sidewall of tubing 210 into tubing 210 and into production string 103.

Downhole assembly 200 may also include port 218, which may be removed to permit access to the portion of annulus 212 downhole from flow control device 206. Port 218 may be coupled to shroud 204 and tubing 210 via a threaded connection. Port 218 may engage with shroud 204 and tubing 210 to form a fluid and pressure tight seal. Port 218 may include a socket or slot into which a tool may be inserted. With a tool inserted into the socket or slot, port 218 may be rotated in order to disengage the threaded connection between port 218 and 204. When port 218 has been removed, plug 208 may be replaced (i.e., a new plug may be installed). For example, after plug 208 has been removed via a chemical reaction causing plug 208 to degrade, the flow of production fluids through channel 214 of flow control device 206 may again be temporarily blocked by replacing plug 208.

Figure 3:
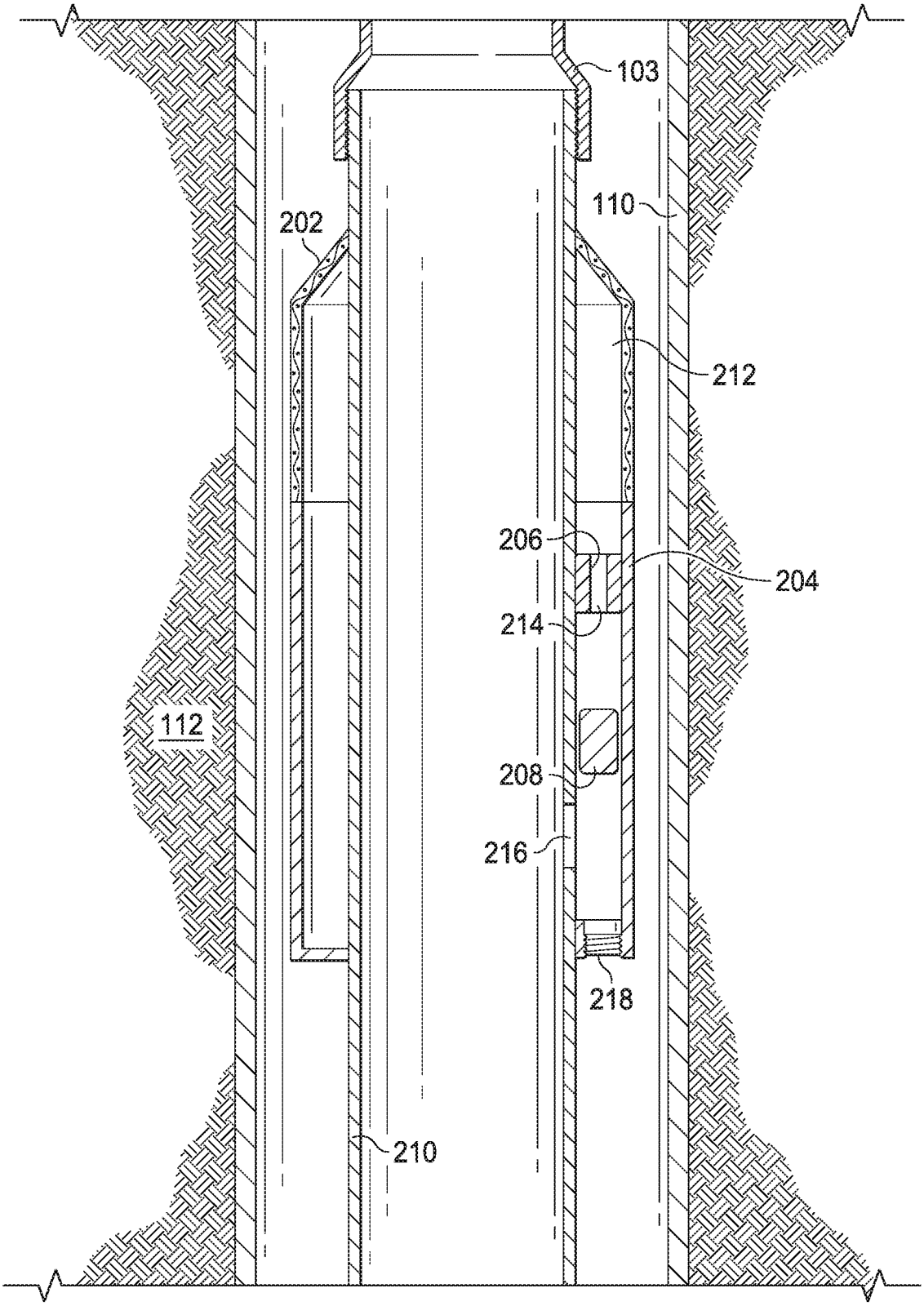
FIG. 3 is a cross-sectional view of a downhole assembly including a degradable plug in-line with and axially displaced from a flow control device.

FIG. 3 is a cross-sectional view of a downhole assembly including a degradable plug in-line with and axially displaced from a flow control device. Production fluids circulating in wellbore 114 may enter downhole assembly 200 by flowing through screen 202 into annulus 212. Production fluids may then flow through channel 214 of flow control device 206 into the portion of annulus 212 downhole from flow control device 206. Production fluids may be temporarily blocked from flowing through opening 216 into tubing 210 and production string 103 by plug 208 disposed in the portion of annulus 212 downhole from flow control device 206. Plug 208 may be positioned in-line with and axially displaced from flow control device 206, as shown in FIG. 3. Plug 208 may engage with shroud 204 and tubing 210 to form a fluid and pressure tight seal, thereby preventing production fluids from flowing into the portion of annulus downhole from plug 208.

Plug 208 may also be used to temporarily block the flow of injection fluids from production string 103 into wellbore 114 and formation 112. For example, the flow of injection fluids from production string into wellbore 114 and formation 112 may be temporarily blocked by plug 208 positioned in-line with and axially displaced from flow control device 206, as shown in FIG. 3. Plug 208 may engage with shroud 204 and tubing 210 to form a fluid and pressure tight seal, thereby preventing injection fluids from flowing into the portion of annulus uphole from flow control device 206.

As explained above with respect to FIG. 2, plug 208 may be formed of a degradable composition including a metal or alloy that is reactive under defined conditions. Plug 208 may be removed from annulus 212 using a chemical reaction that causes plug 208 to degrade, thereby avoiding manual intervention required to extract plug 208 from annulus 212 using a retrieval tool. Once the chemical reaction causing plug 208 to degrade has been triggered, the reaction may continue until plug 208 breaks down into pieces or dissolves into particles small enough that they do not impede the flow of production fluids through annulus 212 or opening 216. When plug 208 has degraded to this point, production fluids may flow through opening 216 into tubing 210 and into the production string 103.

Figure 4:
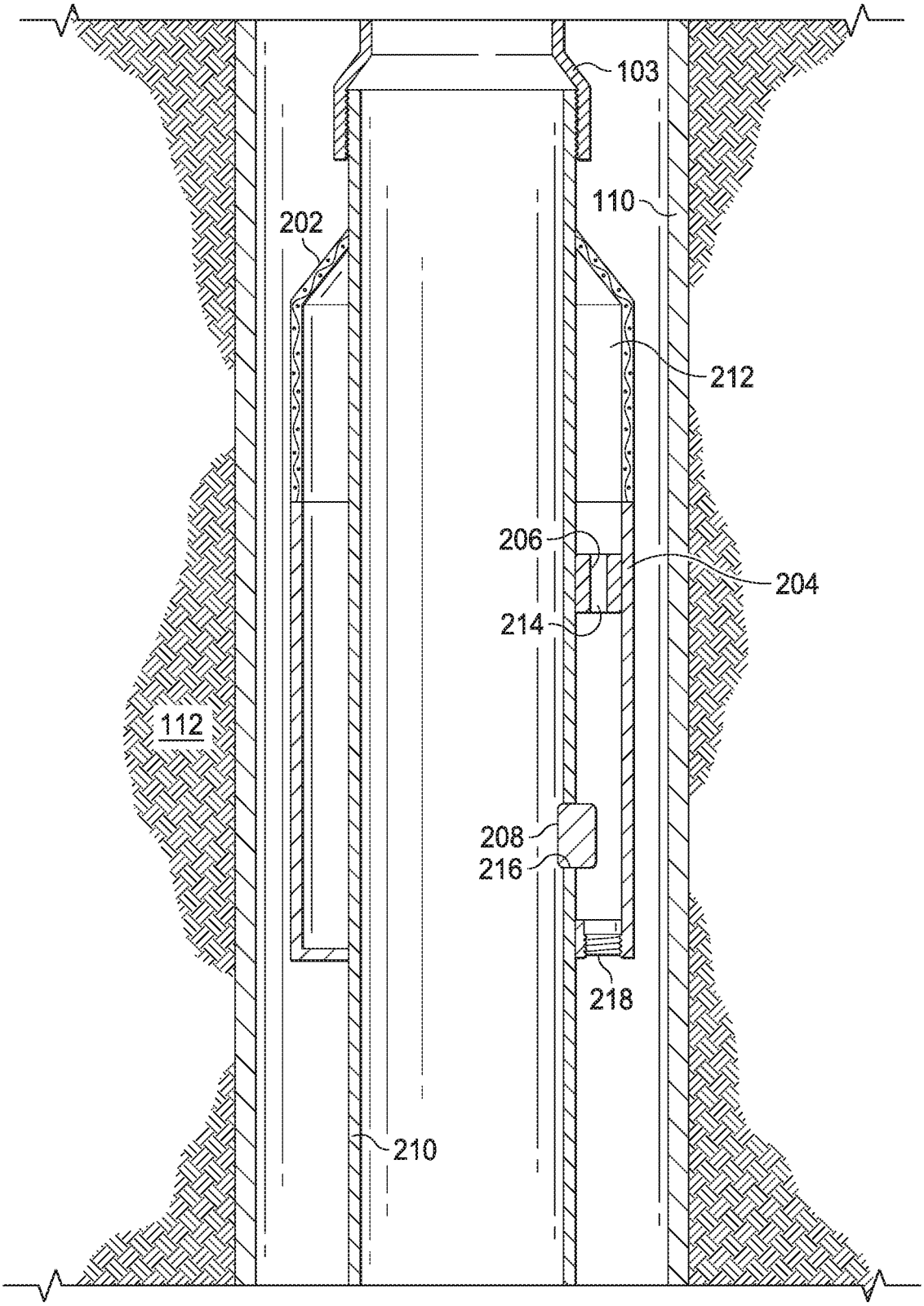
FIG. 4 is a cross-sectional view of a downhole assembly including a degradable plug axially and radially displaced from a flow control device.

FIG. 4 is a cross-sectional view of a downhole assembly including a degradable plug axially and radially displaced from a flow control device. Production fluids circulating in wellbore 114 may enter downhole assembly 200 by flowing through screen 202 into annulus 212. Production fluids may then flow through channel 214 of flow control device 206 into the portion of annulus 212 downhole from flow control device 206. Production fluids may be temporarily blocked from flowing through opening 216 into tubing 210 and production string 103 by plug 208. Plug 208 may be positioned within opening 216 and may engage with opening 216 to form a fluid and pressure tight seal, thereby preventing production fluids from flowing between annulus 212 and tubing 210. Plug 208 may also be used to temporarily block the flow of injection fluids from production string 103 into wellbore 114 and formation 112. For example, the flow of injection fluids from production string into wellbore 114 and formation 112 may be temporarily blocked by plug 208 positioned within opening 216, as shown in FIG. 4. Plug 208 may engage with opening 216 to form a fluid and pressure tight seal, thereby preventing injection fluids from flowing between annulus 212 and tubing 210.

As explained above with respect to FIG. 2, plug 208 may be formed of a degradable composition including a metal or alloy that is reactive under defined conditions. Plug 208 may be removed from opening 216 using a chemical reaction that causes plug 208 to degrade, thereby avoiding manual intervention required to extract plug 208 from opening 216 using a retrieval tool. Once the chemical reaction causing plug 208 to degrade has been triggered, the reaction may continue until plug 208 breaks down into pieces or dissolves into particles small enough that they do not impede the flow of production fluids through opening 216. When plug 208 has degraded to this point, production fluids may flow through opening 216 into tubing 210 and into the production string 103.

A variety of mechanisms may be employed to permit plug 208 to form a fluid and pressure tight seal with shroud 204 and tubing 210 (as discussed with respect to FIGS. 2 and 3) or with opening 216 (as discussed with respect to FIG. 4). FIGS. 5A-5E illustrate exemplary mechanisms that may be used to form a fluid and pressure tight seal between plug 208 and shroud 204 and tubing 210 (as discussed with respect to FIGS. 2 and 3) or opening 216 (as discussed with respect to FIG. 4).

Figure 5A:
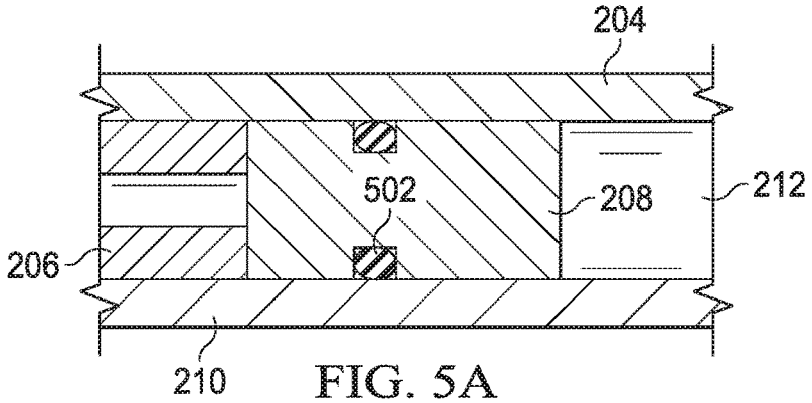
FIG. 5A is a cross-sectional view of a degradable plug including an o-ring seal.

FIG. 5A is a cross-sectional view of a degradable plug including an o-ring seal. Plug 208 may include seal 502 disposed around the circumference of plug 208. Seal 502 may be inset into a groove on the surface of plug 208 (as shown in FIG. 5A) or may be disposed on the surface of plug 208. Although one seal 502 is depicted in FIG. 5A, any number of seals 502 may be used. Seal 502 may be a molded seal made of an elastomeric material. The elastomeric material may be formed of compounds including, but not limited to, natural rubber, nitrile rubber, hydrogenated nitrile, urethane, polyurethane, fluorocarbon, perflurocarbon, propylene, neoprene, hydrin, etc. The elastomeric material may also be a degradable elastomeric material. Examples of degradable elastomeric material include but are not limited to EPDM rubber, natural rubber, elastomers containing polyglocolic acid, elastomers containing polylactic acid, or elastomers containing thiol. Seal 502 may engage with shroud 204 and tubing 210 form a fluid and pressure tight seal.

Although plug 208 is shown in FIG. 5A positioned in-line with and adjacent to flow control device 206, plug 208 may also be positioned in-line with and axially displaced from flow control device 206 (as shown in FIG. 3) or within opening 216 (as shown in FIG. 4). Where plug 208 is positioned as shown in FIG. 3, seal 502 may engage with shroud 204 and tubing 210 to form a fluid and pressure tight seal. Where plug 208 is positioned as shown in FIG. 4, seal 502 may engage with opening 216 to form a fluid and pressure tight seal.

Figure 5B:
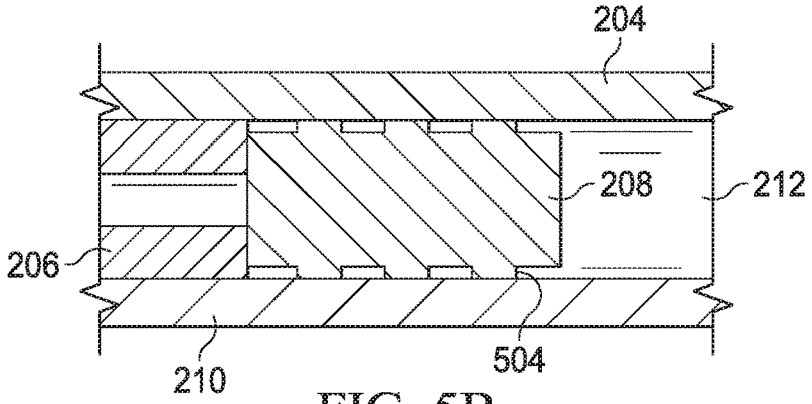
FIG. 5B is a cross-sectional view of a press-fit degradable plug.

FIG. 5B is a cross-sectional view of a press-fit degradable plug. Plug 208 may include protrusions 504 extending radially from the surface of plug 208. The distance that protrusions 504 extend from the surface of plug 208 may be chosen to provide an interference fit between protrusions 504 and the surface with which they are sealing. For example, protrusions 504 may extend radially from the surface of plug 208 to provide an interference fit with shroud 504 and tubing 210. The interference fit between protrusions 504 and shroud 204 and between protrusions 504 and tubing 210 may provide a fluid and pressure tight seal.

Although plug 208 is shown in FIG. 5B positioned in-line with and adjacent to flow control device 206, plug 208 may also be positioned in-line with and axially displaced from flow control device 206 (as shown in FIG. 3) or within opening 216 (as shown in FIG. 4). Where plug 208 is positioned as shown in FIG. 3, the interference fit between protrusions 504 and shroud 204 and between protrusions 504 and tubing 210 may provide a fluid and pressure tight seal. Where plug 208 is positioned as shown in FIG. 4, protrusions 504 may extend radially from the surface of plug 208 to provide an interference fit with opening 216. The interference fit between protrusions 504 and opening 216 may provide a fluid and pressure tight seal.

Figure 5C:
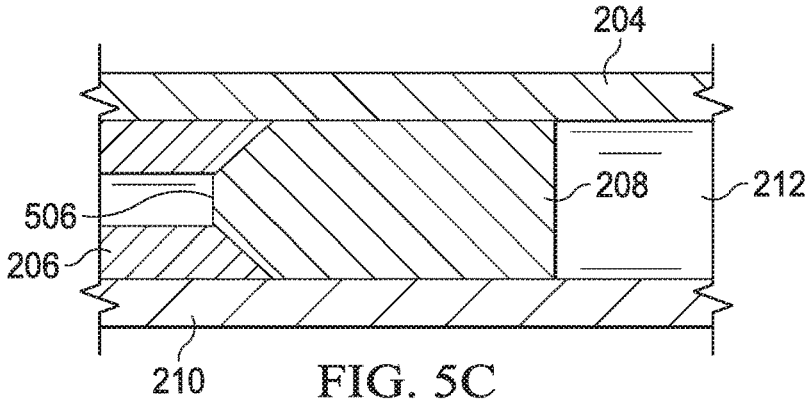
FIG. 5C is a cross-sectional view of a tapered press-fit degradable plug.

FIG. 5C is a cross-sectional view of a press-fit degradable plug. Plug 208 may include tapered end 506. Tapered end 506 of plug 208 may extend partially into channel 214 of flow control device 206. Tapered end 506 may be configured to provide an interference fit between plug 208 and flow control device 206. The interference fit between tapered end 506 and flow control device 206 may provide a fluid and pressure tight seal. Although plug 208 is depicted in FIG. 5C positioned in-line with and adjacent flow control device 206, plug 208 may also be positioned within opening 216 (as shown in FIG. 4). Where plug 208 is positioned as shown in FIG. 4, tapered end 506 may extend partially into opening 216. Tapered end 506 may be configured to provide an interference fit between plug 208 and opening 216. The interference fit between plug 208 and opening 216 may provide a fluid and pressure tight seal.

Figure 5D:
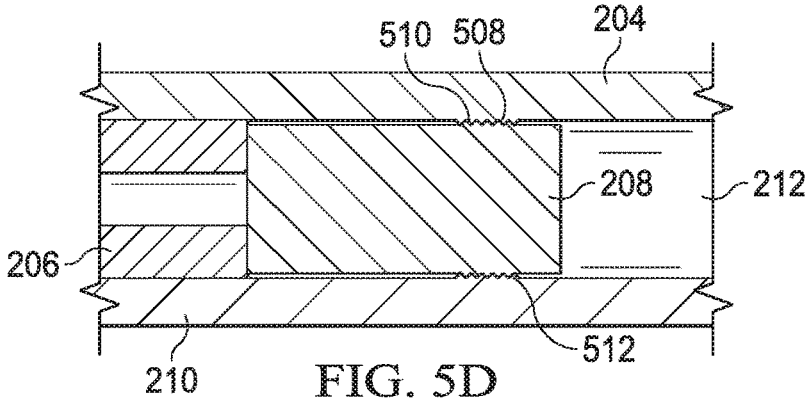
FIG. 5D is a cross-sectional view of a threaded degradable plug.

FIG. 5D is a cross-sectional view of a threaded degradable plug. Plug 208 may include threads 508 configured to engage with threads 510 of shroud 204 and threads 512 of tubing 210. The engagement of threads 508 with threads 510 and threads 512 may provide a fluid and pressure tight seal. Although plug 208 is depicted in FIG. 5D positioned in-line with and adjacent flow control device 206, plug 208 may also be positioned in-line with and axially displaced from flow control device 206 (as shown in FIG. 3) or within opening 216 (as shown in FIG. 4). Where plug 208 is positioned as shown in FIG. 3, the engagement of threads 508 with threads 510 and threads 512 may provide a fluid and pressure tight seal. Where plug 208 is positioned as shown in FIG. 4, threads 508 may be configured to engage with threads formed on the surface of opening 216. The engagement of threads 508 with threads formed on the surface of opening 216 may provide a fluid and pressure tight seal. A sealant may be applied to or disposed within the threads to enhance the seal.

Figure 5E:
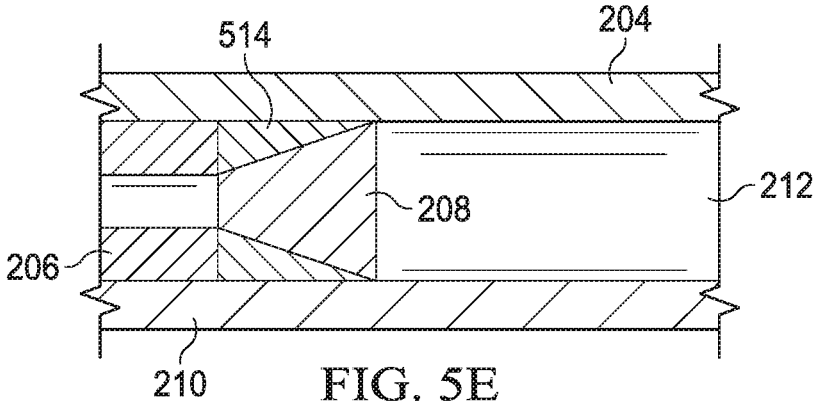
FIG. 5E is a cross-sectional view of a swage-fit degradable plug.

FIG. 5E is a cross-sectional view of a swage-fit degradable plug. Plug 208 may be configured to engage with swage fitting 514 to provide an interference fit between plug 208 and swage fitting 514. Plug 208 may be shrink-fit into swage fitting 514. The interference fit between plug 208 and swage fitting 514 may provide a fluid and pressure tight seal. Although plug 208 and swage fitting 514 are depicted in FIG. 5D positioned adjacent flow control device 206, plug 208 and swage fitting 514 may also be positioned in-line with and axially displaced from flow control device 206 (as shown in FIG. 3). Additionally, plug 208 and swage fitting 514 may be positioned within opening 216 (as shown in FIG. 4).

Figure 6A:
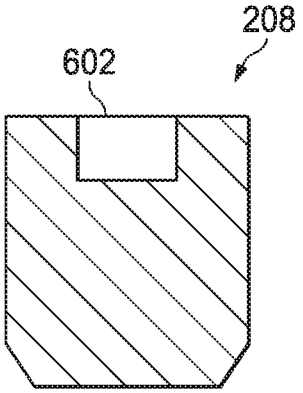
FIG. 6A is a cross-sectional view of a degradable plug formed of a degradable composition that is reactive under defined conditions.

FIGS. 6A-6D illustrate exemplary embodiments of a degradable plug. FIG. 6A is a cross-sectional view of a degradable plug formed of degradable composition that is reactive under defined conditions. Plug 208 may include socket 602 which may be configured to engage with a tool to permit plug 208 to be positioned within or extracted from downhole assembly 200 (shown in FIG. 2). As discussed above with respect to FIG. 2, plug 208 may be formed of a degradable composition including a metal or alloy that is reactive under defined conditions. The composition of plug 208 may be selected such that plug 208 begins to degrade within a predetermined time of first exposure to a corrosive or acidic fluid due to reaction of the metal or alloy from which plug 208 is formed with the corrosive or acidic fluid. Additionally, the composition of plug 208 may be selected such that the degradation of plug 208 accelerates with increasing salinity or with decreasing pH of the corrosive or acidic fluid. The composition of plug 208 may further be selected such that plug 208 degrades sufficiently to form pieces or particles small enough that they do not impede the flow of production fluids through channel 214 of flow control device 206 (shown in FIG. 2) or opening 216 (shown in FIG. 2). The corrosive or acidic fluid may already be present within annulus 212 (shown in FIG. 2) during operation of wellbore 114 (shown in FIG. 1) or may be injected into annulus 212 to trigger a chemical reaction that causes plug 208 to degrade. Additionally, the fluid may be introduced as part of the wellbore cleanup procedures. Examples of corrosive or acidic fluids include organic acids and inorganic acids, such as hydrochloric acid, acetic acid, citric acid, carbonic acid, lactic acid, glycolic acid, and hydrofluoric acid. Exemplary compositions from which plug 208 may be formed include compositions in which the metal or alloy is selected from one of calcium, magnesium, aluminum, and combinations thereof. The composition of plug 208 may be formed from a solution process, from a powder metallurgy process, or from a nanomatrix composite. Additionally or alternatively, the composition of plug 208 may be cast, extruded, or forged. The composition of plug 208 may also be heat treated or annealed.

Plug 208 may also be formed from the metal or alloy imbedded with small particles (e.g., particulates, powders, flakes, fibers, and the like) of a non-reactive material. The non-reactive material may be selected such that it remains structurally intact even when exposed to the corrosive or acidic fluid for a duration of time sufficient to degrade the metal or alloy into pieces or particles small enough that they do not impede the flow of production fluids through channel 214 of flow control device 206 (shown in FIG. 2) or opening 216 (shown in FIG. 2). When the metal or alloy degrades, the small particles of the non-reactive material may remain. The particle size of the non-reactive material may be selected such that the particles are small enough that they do not impede the flow of production fluids through channel 214 of flow control device 206 (shown in FIG. 2) or opening 216 (shown in FIG. 2). The non-reactive material may be selected from one of lithium, bismuth, calcium, magnesium, and aluminum (including aluminum alloys) if not already selected as the reactive metal or alloy, and combinations thereof.

Plug 208 may also be formed from the metal or alloy imbedded with small particles (e.g., particulates, powders, flakes, fibers, and the like) to form a galvanic cell. The composition of the particles may be selected such that the metal from which the particles are formed has a different galvanic potential than the metal or alloy in which the particles are imbedded. Contact between the particles and the metal or alloy in which they are imbedded may trigger microgalvanic corrosion that causes plug 208 to degrade. Exemplary compositions from which the particles may be formed include iron, steel, aluminum alloy, zinc, magnesium, graphite, nickel, copper, carbon, tungsten, and combinations thereof.

Plug 208 may also be formed from an anodic material imbedded with small particles of cathodic material. The anodic and cathodic materials may be selected such that plug 208 begins to degrade upon exposure to a brine fluid, which may also be referred to as an electrolytic fluid, due to an electrochemical reaction that causes the plug to corrode. A brine fluid or electrolytic fluid may include fluids containing NaCL, KCL, and other salts. Exemplary compositions from which the anodic material may be formed include one of magnesium, aluminum, and combinations thereof. Exemplary compositions from which the cathodic material may be formed include one of iron, nickel, copper, graphite, tungsten, and combinations thereof. The anodic and cathodic materials may be selected such that plug 208 is degraded sufficiently within a predetermined time of first exposure to the electrolytic fluid to form pieces or particles small enough that they do not impede the flow of production fluids through channel 214 of flow control device 206 (shown in FIG. 2) or opening 216 (shown in FIG. 2). The electrolytic fluid may already be present within annulus 212 (shown in FIG. 2) during operation of wellbore 114 (shown in FIG. 1) or may be injected into annulus 212 to trigger a electrochemical reaction that causes plug 208 to degrade. As another example, plug 208 may be coated with a material that degrades when exposed to a wellbore fluid. A wellbore fluid may be circulated around the plug 208 in order to degrade the coating. Examples of degradable coatings include EPDM that degrades in crude oil, paint or plastics that degrades in xylene, or PGA or PLA that degrades in water.

Plug 208 may include a coating to temporarily protect the metal or alloy from exposure to the corrosive, acidic, or electrolytic fluid. As an example, plug 208 may be coated with a material that softens or melts when a threshold temperature is reached in annulus 212 (shown in FIG. 2). After the coating softens or melts, the surface of plug 208 may be exposed to the corrosive, acidic, or electrolytic fluid circulating in annulus 212 (shown in FIG. 2). As another example, plug 208 may be coated with a material that fractures when exposed to a threshold pressure. The threshold pressure may be a pressure greater than a pressure that occurs during operation of wellbore 114 (shown in FIG. 1). The pressure in wellbore 114 (shown in FIG. 1) or annulus 212 (shown in FIG. 2) may be manipulated such that it exceeds the threshold pressure, causing the coating to fracture. When the coating fractures, the surface of plug 208 may be exposed to the corrosive, acidic, or electrolytic fluid circulating in annulus 212 (shown in FIG. 2). As yet another example, plug 208 may be coated with a material that erodes when exposed to a particle laden fluid. When the coating erodes, the surface of plug 208 may be exposed to the corrosive, acidic, or electrolytic fluid circulating in annulus 212 (shown in FIG. 2). Exemplary coatings may be selected from a metallic, ceramic, or polymeric material, and combinations thereof. The coating may have low reactivity with the corrosive, acidic, or electrolytic fluid present in annulus 212 (shown in FIG. 2), such that it protects plug 208 from degradation until the coating is compromised allowing the corrosive, acidic, or electrolytic fluid to contact the metal or alloy.

Figure 6B:
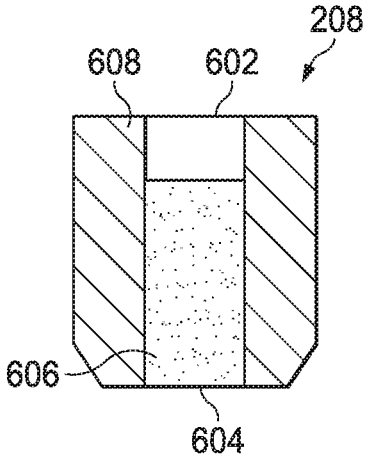
FIG. 6B is a cross-sectional view of a degradable plug including a shell and a core disposed within the shell and formed of a degradable composition that is reactive under defined conditions.

FIG. 6B is a cross-sectional view of a degradable plug including a shell and a core disposed within the shell and formed of a degradable composition that is reactive under defined conditions. Plug 208 may include core 604 disposed within channel 606 extending through shell 608. Core 604 may be removed from shell 606 using a chemical reaction that causes core 604 to degrade. Plug 208 also may include socket 602 which may be configured to engage with a tool to permit plug 208 to be positioned within or extracted from downhole assembly 200 (shown in FIG. 2). Socket 602 may be open to channel 606 such that, when core 604 is removed from shell 608, fluid may flow through plug 208 via socket 602 and channel 606.

Core 604 may be formed of a degradable composition including a metal or alloy that is reactive under defined conditions. The composition of core 604 may be selected such that core 604 begins to degrade within a predetermined time of first exposure to a corrosive or acidic fluid due to reaction of the metal or alloy from which core 604 is formed with the corrosive or acidic fluid. Additionally, the composition of plug 208 may be selected such that the degradation of plug 208 accelerates with increasing salinity or with decreasing pH of the corrosive or acidic fluid. The composition of core 604 may be selected such that core 604 degrades sufficiently to form pieces or particles small enough that they do not impede the flow of production fluids through shell 608. The corrosive or acidic fluid may already be present within annulus 212 (shown in FIG. 2) during operation of wellbore 114 (shown in FIG. 1) or may be injected into annulus 212 to trigger a chemical reaction that causes core 604 to degrade. Additionally, the fluid may be introduced as part of the wellbore cleanup procedures. Examples of corrosive or acidic fluids include organic acids and inorganic acids, such as hydrochloric acid, acetic acid, citric acid, carbonic acid, lactic acid, glycolic acid, and hydrofluoric acid. Exemplary compositions from which core 604 may be formed include compositions in which the metal or alloy is selected from one of calcium, magnesium, aluminum, and combinations thereof. The composition of core 604 may be formed from a solution process, from a powder metallurgy process, or from a nanomatrix composite. Additionally or alternatively, the composition of core 604 may be cast, extruded, or forged. The composition of core 604 may also be heat treated or annealed.

Core 604 may also be formed from the metal or alloy imbedded with small particles (e.g., particulates, powders, flakes, fibers, and the like) of a non-reactive material. The non-reactive material may be selected such that it remains structurally intact even when exposed to the corrosive or acidic fluid for a duration of time sufficient to degrade the metal or alloy into pieces or particles small enough that they do not impede the flow of production fluids through plug 208. When the metal or alloy degrades, the small particles of the non-reactive material may remain. The particle size of the non-reactive material may be selected such that the particles are small enough that they do not impede the flow of production fluids through plug 208. The non-reactive material may be selected from one of lithium, bismuth, calcium, magnesium, and aluminum (including aluminum alloys) if not already selected as the reactive metal or alloy, and combinations thereof.

Core 604 may also be formed from the metal or alloy imbedded with small particles (e.g., particulates, powders, flakes, fibers, and the like) to form a galvanic cell. The composition of the particles may be selected such that the metal from which the particles are formed has a different galvanic potential than the metal or alloy in which the particles are imbedded. Contact between the particles and the metal or alloy in which they are imbedded may trigger microgalvanic corrosion that causes core 604 to degrade. Exemplary compositions from which the particles may be formed include iron, steel, aluminum alloy, zinc, magnesium, graphite, nickel, copper, carbon, tungsten, and combinations thereof.

Core 604 may also be formed from an anodic material imbedded with small particles of cathodic material. The anodic and cathodic materials may be selected such that core 604 begins to degrade upon exposure to a brine fluid, which may also be referred to as an electrolytic fluid, due to an electrochemical reaction that causes the plug to corrode. Brine fluids may include fluids containing NaCl, KCl, and other salts. Exemplary compositions from which the anodic material may be formed include one of magnesium, aluminum, and combinations thereof. Exemplary compositions from which the cathodic material may be formed include one of iron, nickel, copper, graphite, tungsten, and combinations thereof. The anodic and cathodic materials may be selected such that core 604 is degraded sufficiently within a predetermined time of first exposure to the electrolytic fluid to form pieces or particles small enough that they do not impede the flow of production fluids through plug 208. The electrolytic fluid may already be present within annulus 212 (shown in FIG. 2) during operation of wellbore 114 (shown in FIG. 1) or may be injected into annulus 212 to trigger a electrochemical reaction that causes core 604 to degrade.

Core 604 may include a coating to temporarily protect the metal or alloy from exposure to the corrosive, acidic, or electrolytic fluid. As an example, core 604 may be coated with a material that softens or melts when a threshold temperature is reached in annulus 212 (shown in FIG. 2). After the coating softens or melts, the surface of core 604 may be exposed to the corrosive, acidic, or electrolytic fluid circulating in annulus 212 (shown in FIG. 2). As another example, core 604 may be coated with a material that fractures when exposed to a threshold pressure. The threshold pressure may be a pressure greater than a pressure that occurs during operation of wellbore 114 (shown in FIG. 1). The pressure in wellbore 114 (shown in FIG. 1) or annulus 212 (shown in FIG. 2) may be manipulated such that it exceeds the threshold pressure, causing the coating to fracture. When the coating fractures, the surface of core 604 may be exposed to the corrosive, acidic, or electrolytic fluid circulating in annulus 212 (shown in FIG. 2). As yet another example, core 604 may be coated with a material that erodes when exposed to a particle laden fluid. When the coating erodes, the surface of core 604 may be exposed to the corrosive, acidic, or electrolytic fluid circulating in annulus 212 (shown in FIG. 2). Exemplary coatings may be selected from a metallic, ceramic, or polymeric material, and combinations thereof. The coating may have low reactivity with the corrosive or acidic fluid present in annulus 212 (shown in FIG. 2), such that it protects core 604 from degradation until the coating is compromised allowing the corrosive, acidic, or electrolytic to contact the metal or alloy. As another example, core 604 may be coated with a material that degrades when exposed to a wellbore fluid. A wellbore fluid may be circulated around core 604 in order to degrade the coating. Examples of degradable coatings include EPDM that degrades in crude oil, paint or plastics that degrades in xylene, or PGA or PLA that degrades in water.

Shell 608 may be formed of a non-reactive material. The non-reactive material may be selected such that it remains structurally intact even when exposed to the corrosive or acidic fluid for a duration of time sufficient to degrade the metal or alloy from which core 604 is formed into pieces or particles small enough that they do not impede the flow of production fluids through plug 208.

Figure 6C:
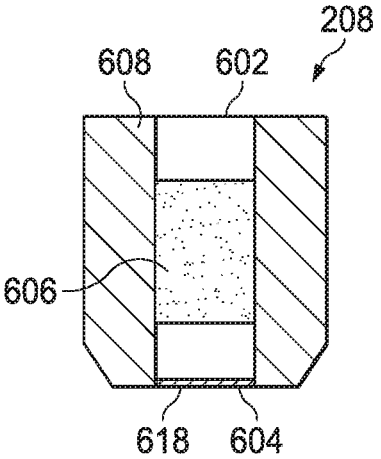
FIG. 6C is a cross-sectional view of a degradable plug including a shell, a core disposed within the shell and formed of a degradable composition that is reactive under defined conditions, and a rupture disk.

FIG. 6C is a cross-sectional view of a degradable plug including a shell, a core disposed within the shell and formed of a degradable composition that is reactive under defined conditions, and a rupture disk. Plug 208 may include socket 602 which may be configured to engage with a tool to permit plug 208 to be positioned within or extracted from downhole assembly 200 (shown in FIG. 2). Plug 208 may also include core 604 disposed within channel 606 extending through shell 608. As discussed above with respect to FIG. 6B, core 604 may be removed from shell 610 using a chemical reaction that causes core 604 to degrade. Socket 602 may be open to channel 606 such that, when core 604 is removed from shell 608, fluid may flow through plug 208 via socket 602 and channel 606.

Plug 208 may further include rupture disk 618 that temporarily protects core 604 from degradation until the rupture disk is compromised allowing the corrosive or acidic fluid to contact the metal or alloy. Rupture disk 618 may be formed of a material that fractures when exposed to a threshold pressure. The threshold pressure may be a pressure greater than a pressure that occurs during operation of wellbore 114 (shown in FIG. 1). The pressure in wellbore 114 (shown in FIG. 1) or annulus 212 (shown in FIG. 2) may be manipulated such that it exceeds the threshold pressure, causing rupture disk 618 to fracture. When rupture disk 618 fractures, the surface of core 604 may be exposed to the brine fluid, corrosive fluid, or acidic fluid circulating in annulus 212 (shown in FIG. 2). As discussed above with respect to FIG. 6B, exposure to the brine fluid, corrosive fluid, or acidic fluid may trigger a chemical reaction or galvanic reaction that causes core 604 to degrade.

As discussed above with respect to FIG. 6B, shell 608 may be formed of a non-reactive material that remains structurally intact even when exposed to the corrosive or acidic fluid for a duration of time sufficient to degrade core 604 is formed into pieces or particles small enough that they do not impede the flow of production fluids through plug 208.

Figure 6D:
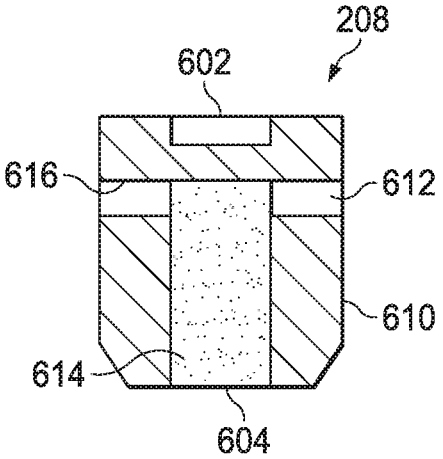
FIG. 6D is a cross-sectional view of a degradable plug including a core formed of a degradable composition that is reactive under defined conditions and disposed within a shell including a diffusion channel.

FIG. 6D is a cross-sectional view of a degradable plug including a core formed of a degradable composition that is reactive under defined conditions and disposed within a shell including a diffusion channel. Plug 208 also may include socket 602 which may be configured to engage with a tool to permit plug 208 to be positioned within or extracted from downhole assembly 200 (shown in FIG. 2). Plug 208 may also include core 604 disposed within channel 614 extending axially through a portion of shell 610. As discussed above with respect to FIG. 6B, core 604 may be removed from shell 610 using a chemical reaction that causes core 604 to degrade.

Shell 610 may include diffusion channel 612 extending radially through shell 610. When core 604 is removed from shell 610, fluid may flow through plug 208 via channel 614 and diffusion channel 612. Surface 616 of shell 610 may act as a diffuser, deflecting fluids flowing through channel 614 into diffusion channel 612. Shell 610 may be formed of a non-reactive material. The non-reactive material may be selected such that it remains structurally intact even when exposed to the corrosive or acidic fluid for a duration of time sufficient to degrade core 604 into pieces or particles small enough that they do not impede the flow of production fluids through plug 208.

Although not illustrated in FIG. 6D, shell 610 may also include rupture disk 618 (shown in FIG. 6C). As discussed with respect to FIG. 6C, rupture disk 618 may temporarily protect core 604 from degradation until the rupture disk is compromised allowing the corrosive or acidic fluid to contact the metal or alloy.

Figure 7:
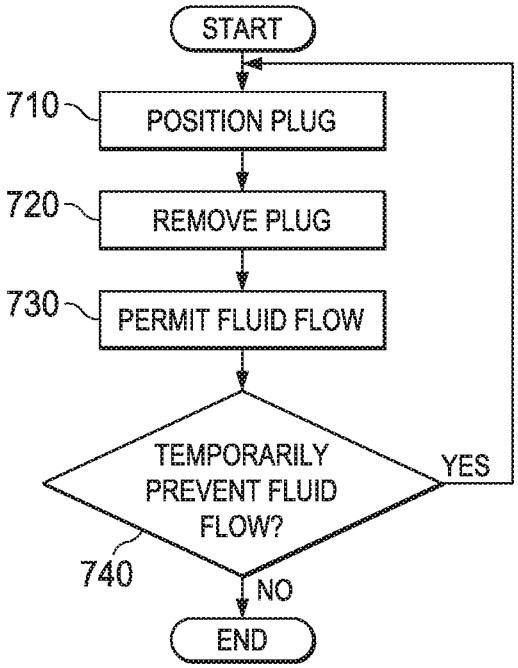
FIG. 7 is a flow-chart of a method of temporarily preventing the flow of production fluids into a production string.

FIG. 7 illustrates a method of temporarily preventing the flow of fluids into or out of a production string. Method 700 may begin, and at step 710, a plug may be positioned within a downhole assembly to temporarily block the flow of production fluids into a production string or injection fluids out of the production string. As discussed above with respect to FIG. 2, the downhole assembly may include a screen and a shroud, which may be coupled to and disposed downhole from the screen. Both the screen and the shroud may be coupled to and disposed around the circumference of tubing coupled to the production string such that an annulus is formed between the inner surfaces of the screen and shroud and the outer surface of the tubing. The downhole assembly may also include a flow control device disposed within the annulus. The plug may be positioned in the portion of the annulus downhole from the flow control device.

In some embodiments, the plug may be positioned in-line with and adjacent to the flow control device, as shown in FIG. 2. In other embodiments, the plug may be positioned in-line with and axially displaced from the flow control device, as shown in FIG. 3. In still other embodiments, the plug may positioned in an opening in the tubing, as shown in FIG. 4. As discussed above with respect to FIGS. 5A-5E, the plug may engage shroud and the tubing or the opening to form a fluid and pressure tight seal. Production fluids circulating in the wellbore may enter the downhole assembly by flowing through the screen and into the annulus, but as discussed above with respect to FIGS. 2-4, the flow of production fluids from the annulus into the tubing and the production string may be temporarily blocked by the plug. Similarly, injection fluids circulating in the production string may be temporarily blocked from flowing into the formation by the plug.

The plug may be positioned within the downhole assembly before the downhole assembly is positioned in the wellbore. Alternatively, the plug may be positioned within the downhole assembly after the downhole assembly is positioned in the wellbore. As discussed above with respect to FIG. 2, the downhole assembly may include a port, which may be removed to permit access to the portion of the annulus downhole from the flow control device. When the port has been removed, the plug may be positioned within the downhole assembly.

At step 720, the plug (or the core of the plug) may be removed in order to permit the flow of fluids into or out of the production string. As discussed above with respect to FIGS. 6A-6D, the plug (or the core of the plug) may be removed by a chemical or electro-chemical reaction that causes the plug (or the core) to degrade. Once the chemical reaction has been triggered, the reaction may continue until the plug (or the core) breaks down into pieces or dissolves into particles small enough that they do not impede the flow of production fluids. For example, where the entire plug degrades, the reaction may continue until the plug breaks down into pieces or dissolves into particles small enough that they do not impede the flow of production fluids through the flow control device or the opening. Where only the core of the plug degrades, the reaction may continue until the core breaks down into pieces or dissolves into particles small enough that they do not impede the flow of production fluids through the flow control device, the opening, or the plug. When the plug (or the core) has degraded to this point, fluids may flow into and out of the production string.

At step 730, the flow of fluids into and out of the production string may be permitted. As discussed above with respect to step 710, production fluids circulating in the wellbore may enter the downhole assembly by flowing through a screen and into the annulus. Production fluids circulating in the annulus may flow through a flow control device disposed in the annulus and into the portion of the annulus downhole from flow the control device. From there, the production fluids may flow through an opening=formed in a sidewall of tubing coupled to the production string and into the production string. Similarly, injection fluids circulating in the production string may flow into the annulus through the opening formed in the sidewall of the tubing. From there, the injection fluids may flow through the flow control device disposed in the annulus and into the formation.

At step 740, a determination may be made regarding whether to temporarily prevent the flow of fluids into or out of the production string. If it is determined to temporarily prevent the flow of fluids into the production string, the method may return to step 710. If it is determined not to temporarily prevent the flow of fluids into the production string, the method may end.

Modifications, additions, or omissions may be made to method 700 without departing from the scope of the present disclosure. For example, the order of the steps may be performed in a different manner than that described and some steps may be performed at the same time. Additionally, each individual step may include additional steps without departing from the scope of the present disclosure.

Embodiments disclosed herein include:

A. A downhole assembly that includes a tube disposed in a wellbore, a shroud coupled to and disposed around the circumference of the tube to form an annulus between an inner surface of the shroud and an outer surface of the tube, a flow control device disposed in the annulus, and a degradable plug disposed in the annulus and positioned to prevent fluid flow between the annulus and the tube.

B. A well system that includes a production string, and a downhole assembly coupled to and disposed downhole from the production string. The downhole assembly includes a tube, a shroud coupled to and disposed around the circumference of the tube to form an annulus between an inner surface of the shroud and an outer surface of the tube, a flow control device disposed in the annulus, and a degradable plug disposed in the annulus and positioned to prevent fluid flow between the annulus and the tube.

C. A method of temporarily preventing fluid flow between a production string and a wellbore that includes positioning a degradable plug in a wellbore such that the plug prevents fluid flow between a production string and a wellbore, and triggering a chemical reaction that causes the degradable plug to degrade to a point where fluid flow between the production string and the wellbore is permitted.

Each of embodiments A, B, and C may have one or more of the following additional elements in any combination: Element 1: the downhole assembly further includes a screen coupled to and disposed uphole from the shroud and coupled to and disposed around the circumference of the tube such that an annulus is formed between an inner surface of the screen and the outer surface of the tube. Element 2: wherein the degradable plug is positioned in-line with and adjacent to the flow control device. Element 3: wherein the degradable plug is positioned in-line with and axially displaced from the flow control device. Element 4: wherein the degradable plug is engaged with the shroud and the tube to form a fluid and pressure tight seal. Element 5: wherein the degradable plug is positioned in an opening formed in a sidewall of the tube, and engaged with the tube to form a fluid and pressure tight seal and prevent fluid flow between the annulus and the tube. Element 6: wherein the degradable plug is formed of a composition that degrades within the annulus within a predetermined time of exposure to a particular fluid. Element 7: wherein the degradable plug includes a degradable plug formed of a composition that degrades within the annulus within a predetermined time of exposure to a particular fluid, and a coating formed around the degradable plug that temporarily protects the degradable plug from exposure to the particular fluid. Element 8: wherein the degradable plug comprises a first composition imbedded with particles of a second composition to form a galvanic cell. Element 9: wherein the degradable plug includes a shell including a channel extending there through, and a degradable core disposed within the channel and formed of a composition that degrades within the annulus within a predetermined time of exposure to a particular fluid. Element 10: wherein the degradable plug includes a shell including a channel extending there through, a degradable core disposed within the shell and formed of a composition that degrades within the annulus within a predetermined time of first exposure to a particular fluid, and a rupture disk that temporarily protects the degradable plug from exposure to the particular fluid, the rupture disk formed of a material that fractures when exposed to a threshold pressure. Element 11: wherein the degradable plug includes a shell including a first channel extending radially there through, and a second channel extending axially from an outer surface of the shell to the first channel, and a degradable core disposed within the second channel and formed of a composition that degrades within the annulus within a predetermined time of exposure to a particular fluid. Element 12: wherein the degradable plug includes a rupture disk that temporarily protects the degradable core from exposure to the particular fluid, the rupture disk formed of a material that fractures when exposed to a threshold pressure.

Element 13: wherein the degradable plug is positioned in fluid communication with a flow control device. Element 14: wherein the chemical reaction is triggered by exposure of the degradable plug to a particular fluid for an amount of time exceeding a threshold time. Element 15: wherein triggering the chemical reaction comprises removing a protective coating formed around the degradable plug to expose the degradable plug to a particular fluid. Element 16: wherein removing the protective coating comprises exposing the degradable plug to a threshold temperature that causes the protective coating to melt. Element 17: wherein removing the protective coating comprises exposing the degradable plug to a threshold pressure that causes the protective coating to fracture. Element 18: wherein the degradable plug degrades into particles small enough that they do not impede fluid flow. Element 19: wherein the chemical reaction causes a core of the degradable plug to degrade to a point where flow of fluids through the degradable plug is permitted. Element 20: wherein triggering the chemical reaction comprises rupturing a rupture disk to expose a core of the degradable plug to a particular fluid for an amount of time exceeding a threshold time.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein.

Although the present disclosure and its advantages have been described in detail, it should be understood that various changes, substitutions and alterations can be made herein without departing from the spirit and scope of the disclosure as defined by the following claims.

What is claimed is:

1. A downhole assembly, comprising:

a tube disposed in a wellbore;

a shroud coupled to and disposed around the circumference of the tube to form an annulus between an inner surface of the shroud and an outer surface of the tube;

a flow control device disposed in the annulus; and a degradable plug disposed in the annulus and positioned to prevent fluid flow between the annulus and the tube, the degradable plug including:

a shell;

a first channel extending radially through the shell;

a second channel extending axially from an outer surface of the shell to the first channel; and a degradable core disposed in the second channel configured to allow fluid flow through the first channel and block the fluid flow through the second channel until the degradable core degrades;

wherein after the degradable core degrades to a point where fluid flow through the second channel is permitted, a surface of the shell is configured to deflect fluid flowing first through the first channel into the second channel.

2. The downhole assembly of claim 1, wherein the degradable core is formed of a composition that degrades within the annulus within a predetermined time of exposure to a particular fluid.

3. The downhole assembly of claim 2, wherein the degradable plug further comprises:

a coating formed around the degradable core that temporarily protects the degradable core from exposure to the particular fluid.

4. The downhole assembly of claim 2, wherein the degradable plug further comprises a rupture disk that temporarily protects the degradable core from exposure to the particular fluid, the rupture disk formed of a material that fractures when exposed to a threshold pressure.

5. The downhole assembly of claim 1, further comprising a screen coupled to and disposed uphole from the shroud and coupled to and disposed around the circumference of the tube such that an annulus is formed between an inner surface of the screen and the outer surface of the tube.

6. The downhole assembly of claim 1, wherein the degradable plug is positioned in-line with and axially displaced from the flow control device.

7. The downhole assembly of claim 1, wherein the degradable plug is positioned in an opening formed in a sidewall of the tube and engaged with the tube to form a fluid and pressure tight seal to prevent fluid flow between the annulus and the tube.

8. The downhole assembly of claim 1, wherein the degradable plug comprises a first composition imbedded with particles of a second composition to form a galvanic cell.

9. A well system comprising:

a production string; and a downhole assembly coupled to and disposed downhole from the production string, the downhole assembly comprising:

a tube;

a shroud coupled to and disposed around the circumference of the tube to form an annulus between an inner surface of the shroud and an outer surface of the tube;

a flow control device disposed in the annulus; and a degradable plug disposed in the annulus and positioned to prevent fluid flow between the annulus and the tube, the degradable plug including:

a shell;

a first channel extending radially through the shell;

a second channel extending axially from an outer surface of the shell to the first channel; and a degradable core disposed in the second channel configured to allow fluid flow through the first channel and block the fluid flow through the second channel until the degradable core degrades;

wherein after the degradable core degrades to a point where fluid flow through the second channel is permitted, a surface of the shell is configured to deflect fluid flowing first through the first channel into the second channel.

10. The well system of claim 9, wherein the degradable core is formed of a composition that degrades within the annulus within a predetermined time of exposure to a particular fluid.

11. The well system of claim 10, wherein the degradable plug further comprises:

a coating formed around the degradable core that temporarily protects the degradable core from exposure to the particular fluid.

12. The well system of claim 10, wherein the degradable plug further comprises a rupture disk that temporarily protects the degradable core from exposure to the particular fluid, the rupture disk formed of a material that fractures when exposed to a threshold pressure.

13. The well system of claim 9, wherein the downhole assembly further comprises a screen coupled to and disposed uphole from the shroud and coupled to and disposed around the circumference of the tube such that an annulus is formed between an inner surface of the screen and the outer surface of the tube.

14. The well system of claim 13, wherein the degradable plug is positioned in an opening formed in a sidewall of the tube, and engaged with the tube to form a fluid and pressure tight seal and prevent fluid flow between the annulus and the tube.

15. The well system of claim 9, wherein the degradable plug is positioned in-line with and axially displaced from the flow control device.

16. A method of temporarily preventing fluid flow between a production string and a wellbore, comprising:

positioning a degradable plug in a wellbore such that the plug prevents fluid flow between a production string and a wellbore, the degradable plug comprising:

a shell including:

a first channel extending radially there through; and a second channel extending axially from an outer surface of the shell to the first channel; and a degradable core disposed in the second channel configured to allow fluid flow through the first channel and block the fluid flow through the second channel until the degradable core degrades; and wherein after the degradable core degrades to a point where fluid flow through the second channel is permitted, a surface of the shell is configured to deflect fluid flowing first through the first channel into the second channel; and triggering a chemical reaction that causes the degradable plug to degrade to a point where fluid flow between the production string and the wellbore is permitted.

17. The method of claim 16, wherein triggering the chemical reaction comprises removing a protective coating formed around the degradable core to expose the degradable core to a particular fluid.

18. The method of claim 17, wherein removing the protective coating comprises exposing the degradable core to a threshold temperature that causes the protective coating to melt or exposing the degradable core to a threshold pressure that causes the protective coating to fracture.

* * * * *